US007804465B2

(12) United States Patent
Kim et al.

(10) Patent No.: US 7,804,465 B2
(45) Date of Patent: Sep. 28, 2010

(54) PLASMA DISPLAY APPARATUS

(75) Inventors: Won Jae Kim, Masan-si (KR); Min Seok Choi, Masan-si (KR)

(73) Assignee: LG Electronics Inc., Seoul (KR)

( * ) Notice: Subject to any disclaimer, the term of this patent is extended or adjusted under 35 U.S.C. 154(b) by 887 days.

(21) Appl. No.: 11/672,978

(22) Filed: Feb. 9, 2007

(65) Prior Publication Data

US 2008/0088541 A1 Apr. 17, 2008

(30) Foreign Application Priority Data

Oct. 16, 2006 (KR) ..... 10-2006-0100547

(51) Int. Cl.
*G09G 3/28* (2006.01)
*G09G 3/10* (2006.01)

(52) U.S. Cl. ..... 345/60; 345/68; 345/37; 345/41; 315/169.4

(58) Field of Classification Search ..... None
See application file for complete search history.

(56) References Cited

U.S. PATENT DOCUMENTS

| | | | | |
|---|---|---|---|---|
| 6,947,016 | B2 * | 9/2005 | Kim et al. | 345/60 |
| 7,423,612 | B2 * | 9/2008 | Choi | 345/60 |
| 2002/0140349 | A1 * | 10/2002 | Kato et al. | 313/582 |
| 2003/0011542 | A1 * | 1/2003 | Nakamura | 345/63 |
| 2005/0073482 | A1 * | 4/2005 | Kim et al. | 345/60 |
| 2005/0264475 | A1 * | 12/2005 | Yim | 345/60 |
| 2006/0103325 | A1 * | 5/2006 | Kim | 315/169.4 |
| 2006/0158387 | A1 * | 7/2006 | Kim | 345/60 |
| 2006/0244685 | A1 * | 11/2006 | Kim et al. | 345/67 |
| 2006/0262041 | A1 * | 11/2006 | An | 345/67 |
| 2007/0063929 | A1 * | 3/2007 | Park et al. | 345/67 |
| 2007/0085771 | A1 * | 4/2007 | Park et al. | 345/67 |
| 2007/0085773 | A1 * | 4/2007 | Moon | 345/67 |

(Continued)

FOREIGN PATENT DOCUMENTS

EP 1 424 679 A 6/2004

(Continued)

OTHER PUBLICATIONS

Korean Decision to Grant a Patent dated Dec. 20, 2007 for Application No. 10-2006-0100547 (English Translation), 3 pages.

(Continued)

*Primary Examiner*—Bipin Shalwala
*Assistant Examiner*—Daniel Bedell
(74) *Attorney, Agent, or Firm*—Fish & Richardson P.C.

(57) ABSTRACT

A plasma display apparatus comprises a plasma display panel and a driver. The plasma display panel comprises a first electrode, a second electrode, and a third electrode crossing the first electrode and the second electrode. During a first frame, the driver alternately supplies a sustain signal to the first electrode and the second electrode and supplies a constant voltage to the third electrode. During a second frame having a smaller APL of the first frame, the driver alternately supplies a sustain signal to the first electrode and the second electrode and supplies an auxiliary signal to the third electrode so as to correspond to at least one sustain signal of the sustain signals supplied to the first electrode and the second electrode.

21 Claims, 12 Drawing Sheets

U.S. PATENT DOCUMENTS

| | | | | |
|---|---|---|---|---|
| 2007/0171149 | A1 | 7/2007 | Hashimoto | |
| 2008/0158103 | A1* | 7/2008 | Chung et al. | 345/60 |
| 2009/0015573 | A1* | 1/2009 | Nagase et al. | 345/204 |

FOREIGN PATENT DOCUMENTS

| | | | |
|---|---|---|---|
| JP | 2000-242223 | A | 9/2000 |
| KR | 10 2003-0046023 | A | 6/2003 |
| KR | 10 2005-0056821 | A | 6/2005 |
| KR | 10 2005-0080611 | A | 8/2005 |
| KR | 10 2006-0022269 | A | 3/2006 |
| KR | 10 2007-0043381 | A | 4/2007 |
| WO | WO 2004/114270 | A | 12/2004 |

OTHER PUBLICATIONS

European Search Report dated Oct. 8, 2009 for Application No. 07250466.5, 6 pages.

Sang-Hun Jang, et al.; "Improvement of Luminance and Luminous Efficiency Using Address Voltage Pulse During Sustain-Period of AC-PDP"; IEEE Transaction on Electron devices, vol. 48, No. 9, Sep. 2001, 8 pages.

* cited by examiner

PLASMA DISPLAY APPARATUS

This nonprovisional application claims priority under 35 U.S.C. §119(a) on Patent Application No. 10-2006-0100547 filed in Republic of Korea on Oct. 16, 2006, the entire contents of which are hereby incorporated by reference.

BACKGROUND

1. Field

This document relates to a plasma display apparatus.

2. Related Art

A plasma display apparatus may comprise a plasma display panel having electrodes and a driver supplying a driving signal to the electrodes of the plasma display panel.

The plasma display panel comprises discharge cells partitioned by barrier ribs. Within each of the discharge cells, a phosphor layer is formed. When the driver supplies a driving signal, discharge is generated within the discharge cells.

Accordingly, a discharge gas filled in the discharge cell generates ultraviolet rays, and the ultraviolet rays excite the phosphor layer formed in the discharge cell. The phosphor layer excited by the ultraviolet rays emits visible rays to the outside. Then, the plasma display panel displays an image.

SUMMARY

In an aspect, a plasma display apparatus comprises a plasma display panel including a first electrode, a second electrode, and a third electrode crossing the first electrode and the second electrode, and a driver supplying sustain signals to the first electrode and the second electrode and supplying a constant voltage to the third electrode during a first frame, and supplying sustain signals to the first electrode and the second electrode and supplying an auxiliary signal to the third electrode corresponding to at least one sustain signal of the sustain signals supplied to the first electrode and the second electrode during a second frame having an APL smaller than an APL of the first frame.

In another aspect, the polarity of the sustain signal is the same as that of the auxiliary signal.

In a further aspect, the driver supplies a data signal to the third electrode during an address period, and the level of the highest voltage of the auxiliary signal is lower than that of the data signal.

In a still further aspect, the constant voltage is substantially equal to a ground-level voltage.

In a still further aspect, an overall supply period of each of the supply period of the sustain signal and the auxiliary signal comprises a voltage-rising period, a voltage sustain period, and a voltage-falling period, and an absolute value of slope of the auxiliary signal in each of the voltage-rising period and the voltage-falling period is smaller than that of the sustain signal in each of the voltage-rising period and the voltage-falling period.

In a still further aspect, the ratio of the highest voltage of the sustain signal to the highest voltage of the auxiliary signal, may range from 1.8 to 50.

In a still further aspect, a distance between the first electrode and the second electrode may be equal to or more than 60 μm.

In a still further aspect, a distance between the first electrode and the second electrode may be equal to or more than 100 μm.

In a still further aspect, the distance between the first electrode and the second electrode is larger than a distance between the first electrode and the third electrode or between the second electrode and the third electrodes.

In a still further aspect, the driver supplies the sustain signal and the auxiliary signal in at least one sub-field among a plurality of sub-fields of the second frame.

In a still further aspect, a plasma display apparatus comprises a plasma display panel including a first electrode, a second electrode, and a third electrode crossing the first electrode and the second electrode, and a driver supplying sustain signals to the first electrode and the second electrode and supplying a constant voltage to the third electrode during a first frame in which a first image is displayed, and supplying sustain signals to the first electrode and the second electrode and supplying an auxiliary signal to the third electrode corresponding to at least one sustain signal of the sustain signals supplied to the first electrode and the second electrode during a second frame in which a second image having an area smaller than an area of the first image is displayed.

In a still further aspect, the polarity of the sustain signal is the same as that of the auxiliary signal.

In a still further aspect, the driver supplies a data signal to the third electrode during an address period, and the highest voltage level of the auxiliary signal is lower than that of the data signal.

In a still further aspect, the plasma display panel comprises an effective region in which light is emitted and an ineffective region is not emitted, and the area of the second image is more than 40% of the effective region.

In a still further aspect, the plasma display panel comprises an effective region in which light is emitted and an ineffective region is not emitted, and the area of the second image is more than 60% of the effective region.

In a still further aspect, a distance between the first electrode and the second electrode may be equal to or more than 100 μm.

In a still further aspect, the distance between the first electrode and the second electrode is larger than a distance between the first electrode and the third electrode or between the second electrode and the third electrodes.

In a still further aspect, the driver supplies the sustain signal and the auxiliary signal in at least one sub-field among a plurality of sub-fields of the second frame.

In a still further aspect, a plasma display apparatus comprises a plasma display panel including a first electrode, a second electrode, and a third electrode crossing the first electrode and the second electrode, and a driver supplying sustain signals to the first electrode and the second electrode and supplying a constant voltage to the third electrode during a first frame, and supplying sustain signals to the first electrode and the second electrode and floating the third electrode to correspond to at least one sustain signal of the sustain signals supplied to the first electrode and the second electrode during a second frame having an APL smaller than an APL of the first frame.

In a still further aspect, a distance between the first electrode and the second electrode is 100 μm.

BRIEF DESCRIPTION OF THE DRAWINGS

The implementation of this document will be described in detail with reference to the following drawings in which like numerals refer to like elements.

DETAILED DESCRIPTION

Hereinafter, an embodiment according to the present invention will be described in detail with reference to the attached drawings.

Figure 1:
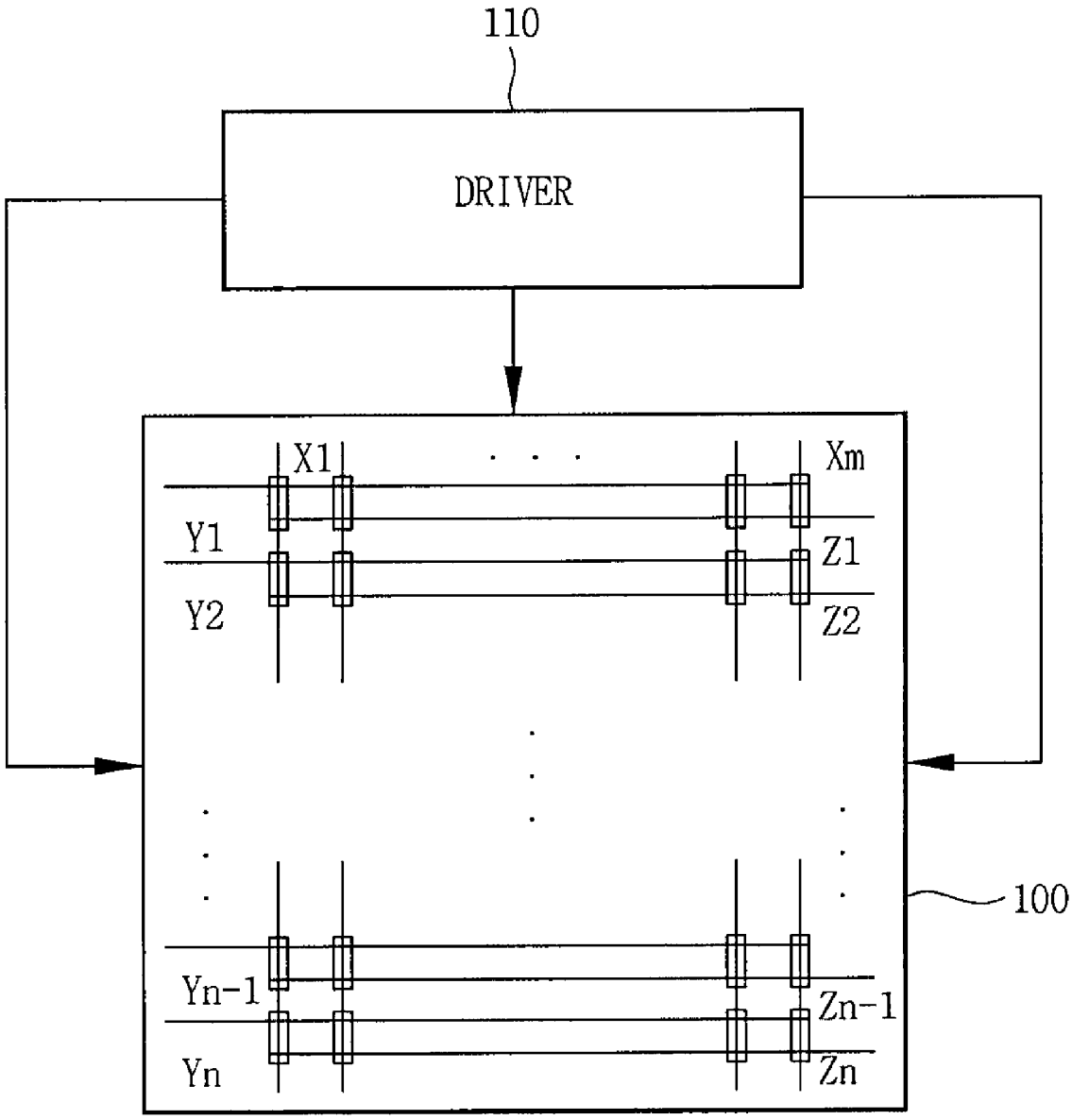
FIG. 1 is a diagram illustrating a plasma display apparatus according to an embodiment of the present invention.

As shown in FIG. 1, a plasma display apparatus according to an embodiment of the invention comprises a plasma display panel 100 and a driver 110.

The plasma display panel 100 comprises first electrodes Y1 to Yn, second electrodes Z1 to Zn, and third electrodes X1 to Xm. The first electrodes Y1 to Yn and the second electrodes Z1 to Zn are disposed in parallel to each other, and the third electrodes X1 to Xm are disposed so as to cross the first electrodes Y1 to Yn and the second electrodes Z1 to Zn.

During a first frame, the driver 110 alternately supplies sustain signals to the first electrodes Y1 to Yn and the second electrodes Z1 to Zn and supplies a constant voltage to the third electrodes X1 to Xm. During a second frame having an APL (average picture level) smaller than an APL of the first frame, the driver 110 alternately supplies sustain signals to the first electrodes Y1 to Yn and the second electrodes Z1 to Zn and supplies an auxiliary signal to the third electrodes X1 to Xm corresponding to at least one of the sustain signals supplied to the first electrodes Y1 to Yn and the second electrodes Z1 to Zn.

During the first frame in which a first image is displayed, the driver 110 alternately supplies sustain signals to the first electrodes Y1 to Yn and the second electrodes Z1 to Zn and supplies a constant voltage to the third electrodes X1 to Xm. During the second frame in which a second image having an area smaller than an area of the first image, is displayed, the driver 110 alternately supplies sustain signals to the first electrodes Y1 to Yn and the second electrodes Z1 to Zn and supplies an auxiliary signal to the third electrodes X1 to Xm corresponding to at least one of the sustain signals supplied to the first electrodes Y1 to Yn and the second electrodes Z1 to Zn.

During the first frame, the driver 110 alternately supplies sustain signals to the first electrodes Y1 to Yn and the second electrodes Z1 to Zn and supplies a constant voltage to the third electrodes X1 to Xm. During the second frame having an APL smaller than an APL of the first frame, the driver 110 alternately supplies sustain signals to the first electrodes Y1 to Yn and the second electrodes Z1 to Zn and floats the third electrodes X1 to Xm corresponding to at least one of the sustain signals supplied to the first electrodes Y1 to Yn and the second electrodes Z1 to Zn.

In this embodiment, a constant voltage may be substantially equal to a ground-level voltage.

Figure 2:
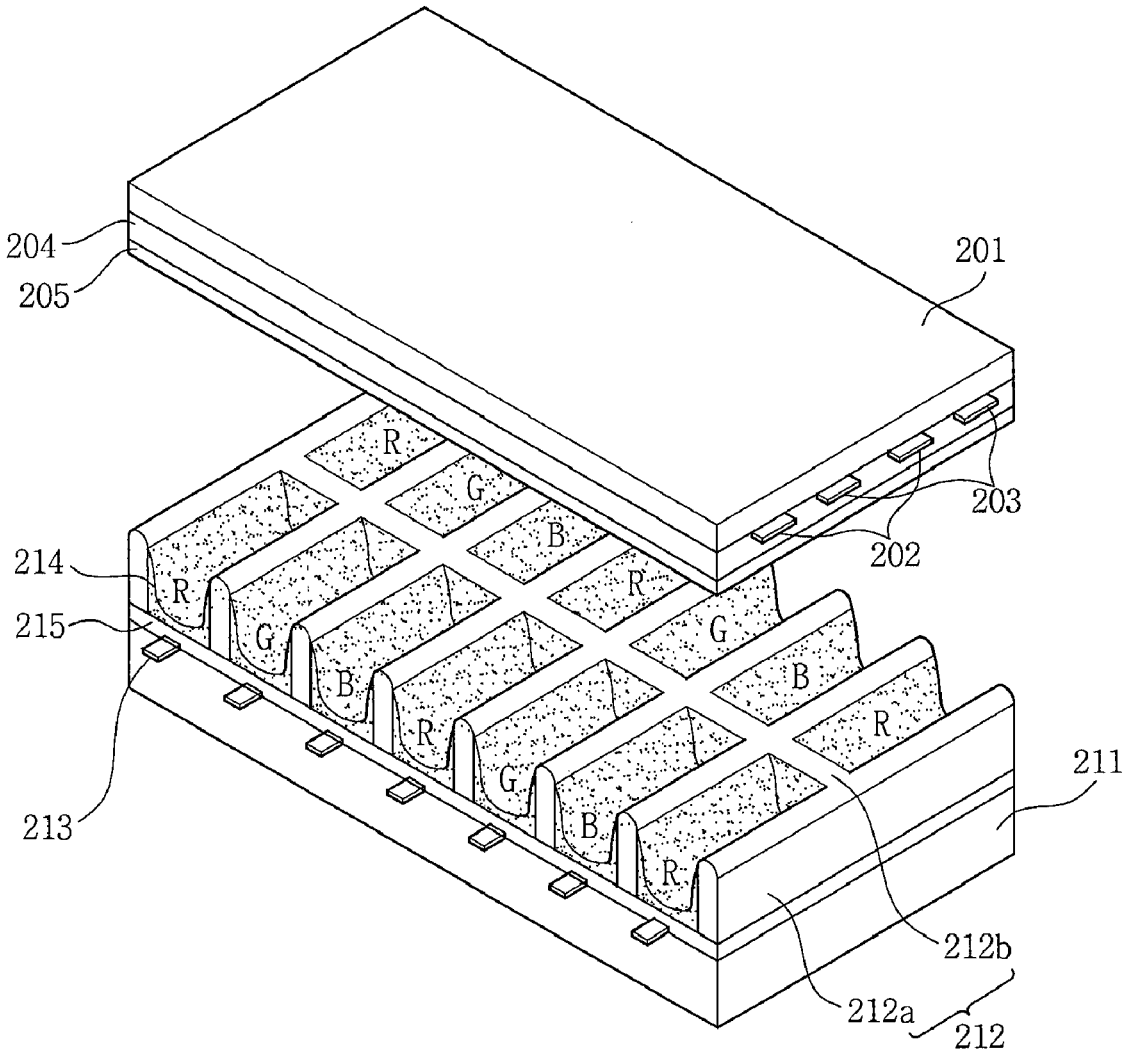
FIG. 2 is a diagram illustrating a plasma display panel of the plasma display apparatus according to the embodiment of the invention.

The plasma display panel of FIG. 2 comprises a front substrate 201, on which the first electrodes 202 and the second electrodes 203 are disposed in parallel to each other, and a rear substrate 211 on which the third electrodes 213 crossing the first electrode and the second electrode 202 and 203 are disposed.

On the front substrate 201, the first electrodes 202 and the second electrodes 203 are disposed in parallel to each other. The first electrode and the second electrode 202 and 203 are covered by an upper dielectric layer 204.

The upper dielectric layer 204 limits discharge currents of the first electrode and the second electrode 202 and 203. The first electrode and the second electrode 202 and 203 are insulated from each other by the upper dielectric layer 204.

The upper dielectric layer 204 is covered by a protective layer 205. The protective layer 205 protects the upper dielectric layer 204, the first electrodes 202, and the second electrodes 203 and discharges secondary electrons.

On the rear substrate 211, the third electrodes 213 are disposed so as to cross the first electrode and the second electrode 202 and 203. The third electrodes 213 are covered by a lower dielectric layer 215 by which the third electrodes 213 are insulated from each other. On the lower dielectric layer 215, barrier ribs 212 are positioned so as to partition discharge cells. Between the barrier ribs 212 and 212, a phosphor layer 214 is positioned. The widths of R, G, and B discharge cells may be substantially identical to each other. However, the widths of R, G, and B discharge cells may be different from each other, in order to adjust color temperature.

In this embodiment, the plasma display panel can be formed to have a variety of barrier rib structures as well as the barrier rib structure shown in FIG. 2. For example, the barrier rib 212 comprises first and second barrier ribs 212*b* and 212*a*, and the heights of the first and second barrier ribs 212*b* and the 212*a* may be different from each other. Further, a channel which can be used as an exhaust path may be formed in at least one of the first and second barrier ribs 212*b* and 212*a*. At least one of the first and second barrier ribs 212*b* and 212*a* may have a groove formed therein.

Although it is shown in FIG. 2 that the respective R, G, and B discharge cells are arranged on the same line, the R, G, and B discharge cells may be arranged in a triangle shape. Further, the discharges cells may be formed in a pentagonal or hexagonal shape as well as a rectangular shape.

The phosphor layer 214 may further comprise a white (W) layer and/or a yellow (Y) phosphor layer as well as red (R), green (G), and blue (B) phosphor layers.

The upper and lower dielectric layers 204 and 205, respectively, may further comprises one layer and a plurality of layers. In order to prevent external light from being reflected, a black layer (not shown) may be disposed on the barrier rib 212. Further, a black layer (not shown) may be formed on a specific position of the front substrate 201 corresponding to the barrier rib 212.

Figure 3:
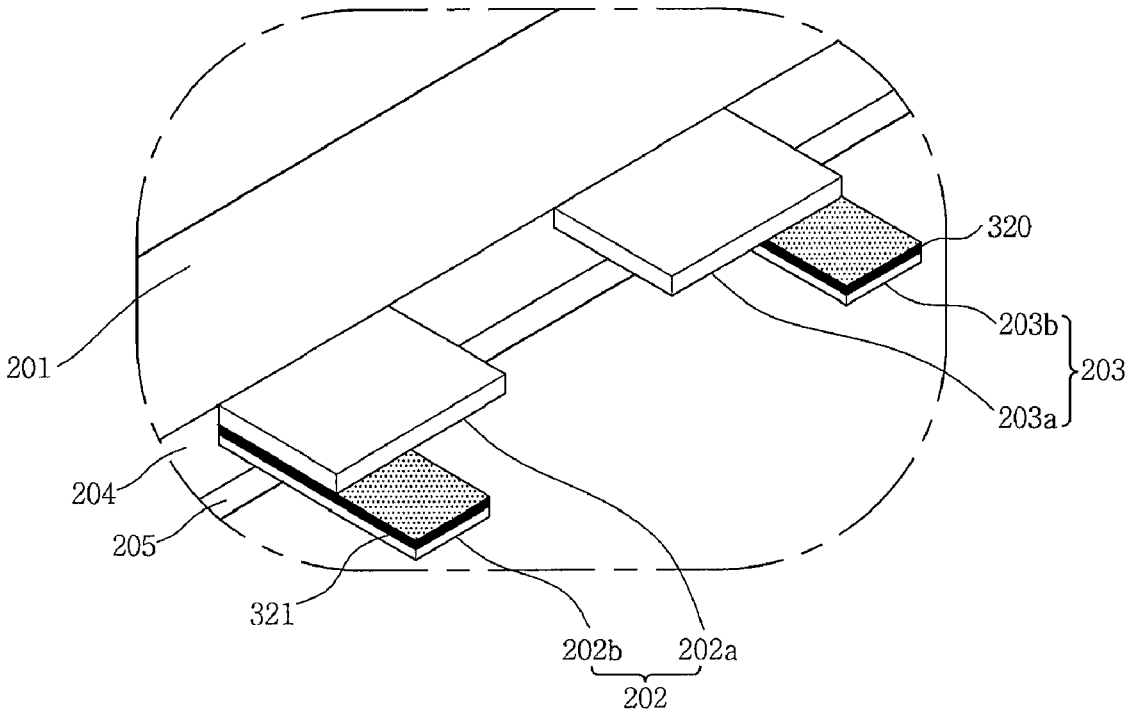
FIG. 3 is a diagram illustrating the electrode structure of the plasma display panel of FIG. 2.

Although the first electrode and the second electrode 202 and 203 of FIG. 2, respectively, comprises only a bus electrode, transparent electrodes 202*a* and 203*a* and bus electrodes 202*b* and 203*b* may be comprised therein, as shown in FIG. 3. Further, between the transparent electrodes 202*a* and 203*a* and the bus electrodes 202*b* and 203*b*, black layers 320 and 321 may be respectively disposed, the black layers 320 and 321 preventing light from being reflected.

Figure 4:
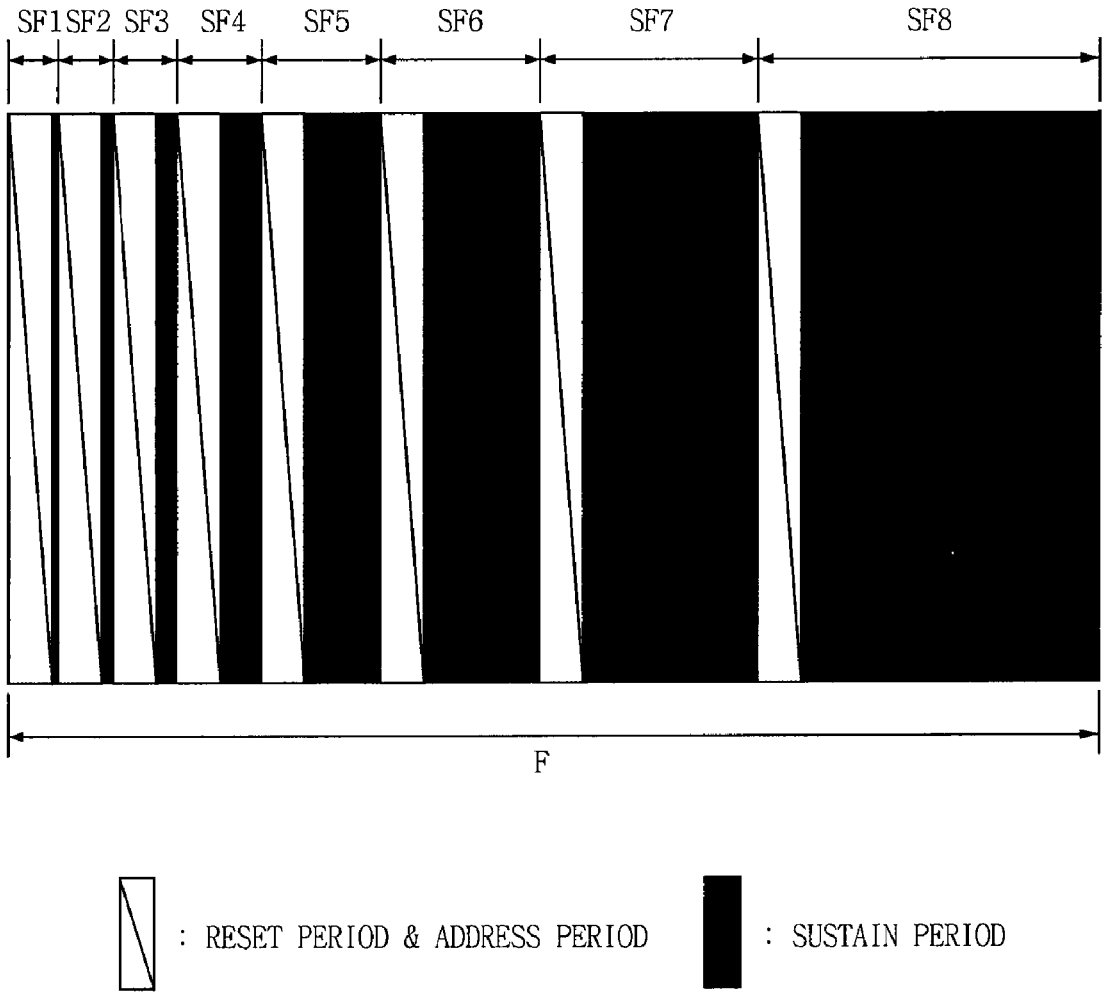
FIG. 4 is a diagram showing a method of representing a gray level in the plasma display apparatus according to the embodiment of the invention.

As shown in FIG. 4, the plasma display apparatus according to the invention displays an image in each sub-field of a frame F. The frame comprises a plurality of sub-fields SF1 to SF8, each sub-field including a reset period, an address period, and a sustain period.

Depending on a sustain period of each sub-field, a gray level weight is set. The gray level weight of each sub-field increases in the ratio of $2^n$ (here, n=0, 1, 2, 3, 4, 5, 6, 7). In each sub-field, the number of sustain signals supplied during a sustain period of each sub-field is adjusted in accordance with a gray level weight such that a gray level is represented.

The frame F of FIG. 4 comprises eight sub-fields but may comprise more than eight sub-fields. Further, in FIG. 4, the sub-fields are arranged in an order where a gray level weight increases. However, the sub-fields may be arranged in an order where a gray level weight decreases or at random.

Figure 5:
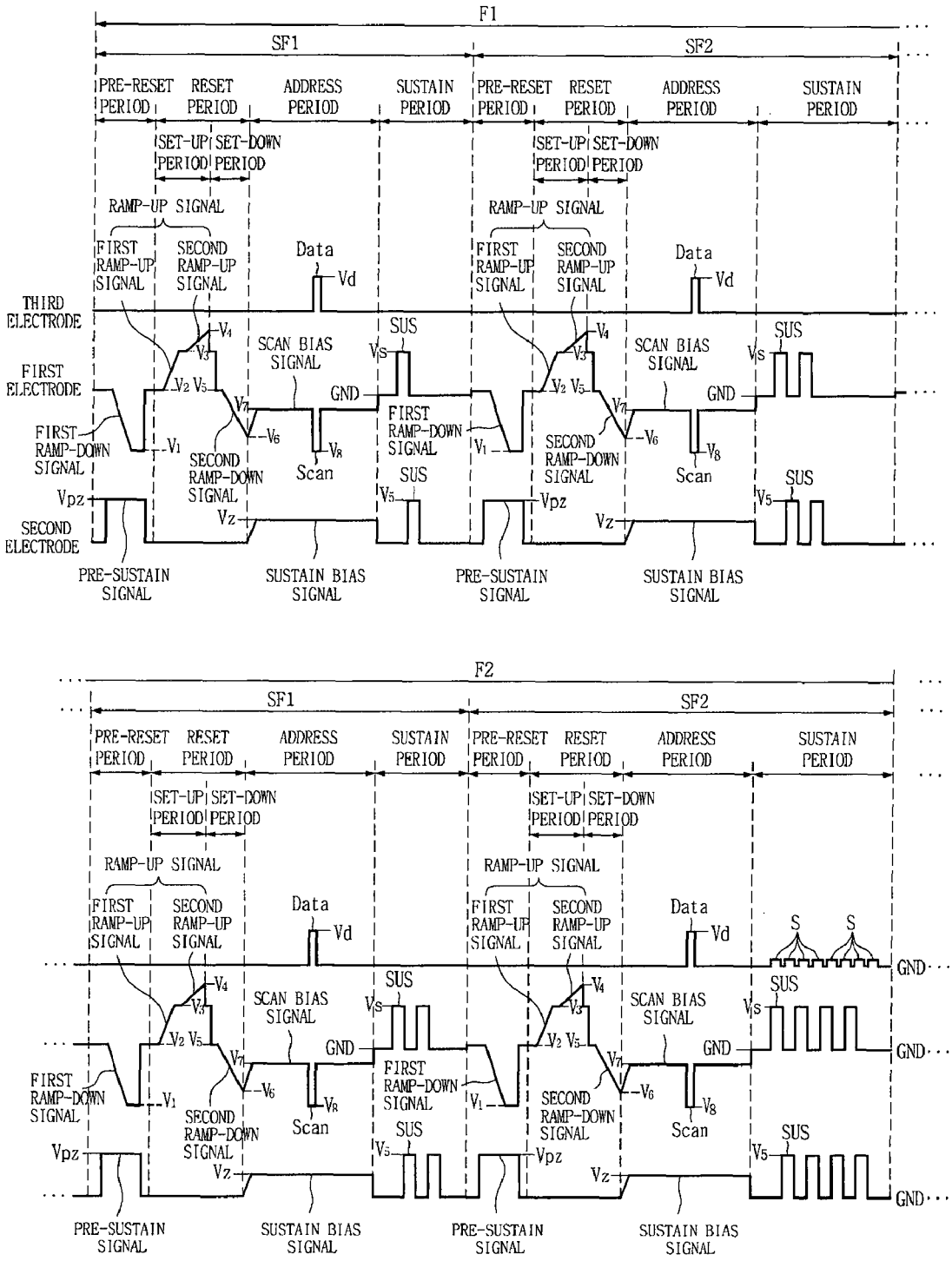
FIG. 5 is a diagram showing a driving signal of the plasma display apparatus according to the embodiment of the invention.

As shown in FIG. 5, the plasma display apparatus displays an image during first and second frames F1 and F2. Each of the first and second frames F1 and F2 comprises a pre-reset period, a reset period, an address period, and a sustain period.

During the pre-reset period, the driver 110 of FIG. 1 supplies a first ramp-down signal to the first electrode Y, the first ramp-down signal gradually falling to a first voltage V1. Further, the driver 110 supplies a pre-sustain signal to the second electrode Z, the pre-sustain signal having a reverse polarity to that of the first ramp-down signal.

The highest voltage of a pre-sustain signal is a pre-sustain voltage Vpz. The pre-sustain voltage Vpz can be substantially identical to a sustain voltage which is the highest voltage of a sustain signal SUS.

In accordance with the first ramp-down signal and the pre-sustain signal supplied during the pre-reset period, positive wall charges are accumulated on the first electrode Y and negative wall charges are accumulated on the second electrode Z. During a reset period, stable set-up discharge is generated by the wall charges formed during the pre-reset period. Accordingly, although the level of the highest voltage of a ramp-up signal to be supplied during the reset period is low, stable set-up discharge is possible.

The pre-reset period may be comprised in at least one sub-field of the plurality of sub-fields comprised in one frame. Accordingly, it is possible to prevent reduction in driving period, which is caused by the addition of the free reset period. Further, the pre-reset period does not need to be comprised in each of the overall sub-fields.

During a set-up period of the reset period, the driver 110 supplies a ramp-up signal to the first electrode Y, the ramp-up signal having a reverse polarity to that of the first ramp-down signal. The ramp-up signal comprises a first ramp-up signal, which gradually rises from a second voltage V2 to a third voltage V3, and a second ramp-up signal which gradually rises from the third voltage V3 to a fourth voltage V4. In accordance with the ramp-up signal, set-up discharge is generated within the discharge cell. Within the discharge cell, sufficient wall charges are formed by the set-up discharge.

The slope of the second ramp-up signal may be smaller than that of the first ramp-up signal. When the slope of the second ramp-up signal is smaller than that of the first ramp-up signal, a voltage rises relatively rapidly before the set-up discharge is generated. Further, while the set-up discharge is generated, a voltage rises relatively slowly. Accordingly, an amount of light generated by the set-up discharge decreases, and a contrast characteristic is improved.

During a set-down period after the set-up period, the driver 110 supplies a second ramp-down signal to the first electrode Y, the second ramp-down signal having a reverse polarity to that of the ramp-up signal. The second ramp-down signal gradually falls from a fifth voltage V5 to a sixth voltage V6.

Accordingly, set-down discharge is generated within the discharge cell. The wall charges within the overall discharge cell are uniformized by the set-down discharge.

During an address period, the driver 110 supplies a scan bias signal to the first electrode Y. The voltage level of the scan bias signal is substantially identical to that of a seventh voltage V7. Further, the driver 110 supplies a scan signal to the first electrode Y, the scan signal falling from the seventh voltage V7 to an eighth voltage V8. The width of a scan signal in at least one sub-field of the plurality of sub-fields may be different from those of scan signals in the rest of the sub-fields.

In synchronization with the scan signal, the driver 110 supplies a data signal to the third electrode X.

When the scan signal and the data signal are supplied, a voltage difference between the lowest voltage V8 of the scan signal and the highest voltage Vd of the data signal is added to a wall voltage due to the wall charges generated during the reset period.

The driver 110 supplies a sustain bias signal to the second electrode Z in order to perform stable address discharge during the address period. The level of the highest voltage Vz of a sustain bias signal is lower than that of the highest voltage Vs of a sustain signal and is higher than that of a ground voltage GND.

In this embodiment, the waveforms of signals supplied during the pre-reset periods, the reset periods, and the address periods of the first and second frames F1 and F2 are identical to each other, as shown in FIG. 5.

Figure 6:
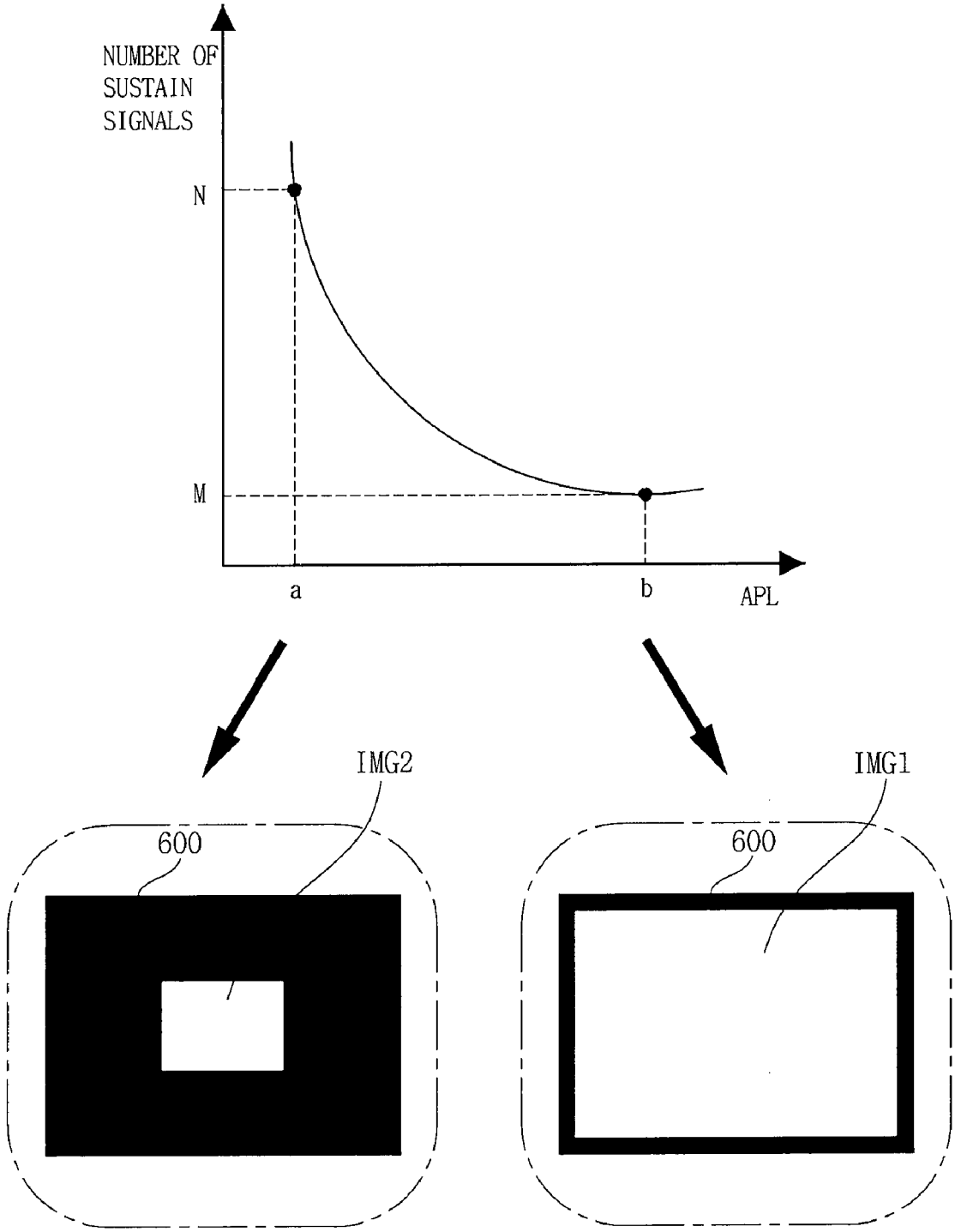
FIG. 6 is a diagram showing the number of sustain pulses in accordance with an APL.

As shown in FIGS. 5 and 6, when the APL of the second frame F2 is smaller than that of the first frame F1, the number of sustain signals to be assigned to the second frame F2 is larger than the number of sustain signals to be assigned to the first frame F1.

For example, when the APL of the second frame is a and the APL of the first frame F1 is b, the number of sustain signals to be assigned to the second frame F2 is N, and the number of sustain signals to be assigned to the first frame F1 is M.

In other words, when the APL of the second frame F2 is a, a second image IMG2 is displayed on an effective region 600 of the plasma display panel. When the APL of the first frame F1 is b, a first image IMG1 is displayed on the effective region 600 of the plasma display panel. In this case, the number of sustain signals to be assigned to the second frame F2 is N, and the number of sustain signals to be assigned to the first frame F1 is M.

In the entire region of the plasma display panel, the effective region 600 of the plasma display panel is such a region that can emit light.

During the sustain periods of the first and second frames F1 and F2, the driver 110 alternately supplies a sustain signal to the first electrode Y and the second electrode Z. Further, the driver 110 supplies an auxiliary signal S to the third electrode X corresponding to at least one of the sustain signals supplied to the first electrode Y and the second electrode z during the sustain period of the second frame F2.

During the second frame F2 having a lager APL than the first frame F1, an auxiliary signal S is supplied so as to correspond to the sustain signal SUS supplied to the first or second electrode, as shown in FIG. 7.

The overall supply period of each of the sustain signal SUS and the auxiliary signal S comprises a voltage-rising period, a voltage sustain period, and a voltage-falling period. An absolute value of slope of the auxiliary signal in each of the voltage-rising period and the voltage-falling period can be smaller than that of the sustain signal in each of the voltage-rising period and the voltage-falling period. In this embodiment, the highest voltage V10 of an auxiliary signal may be more than 5V and less than 100V. The highest voltage of the sustain signal SUS may range 180V to 250V. The ratio of the highest voltage of the sustain signal to the highest voltage of the auxiliary signal, may range from 1.8 to 50.

Figure 7A:
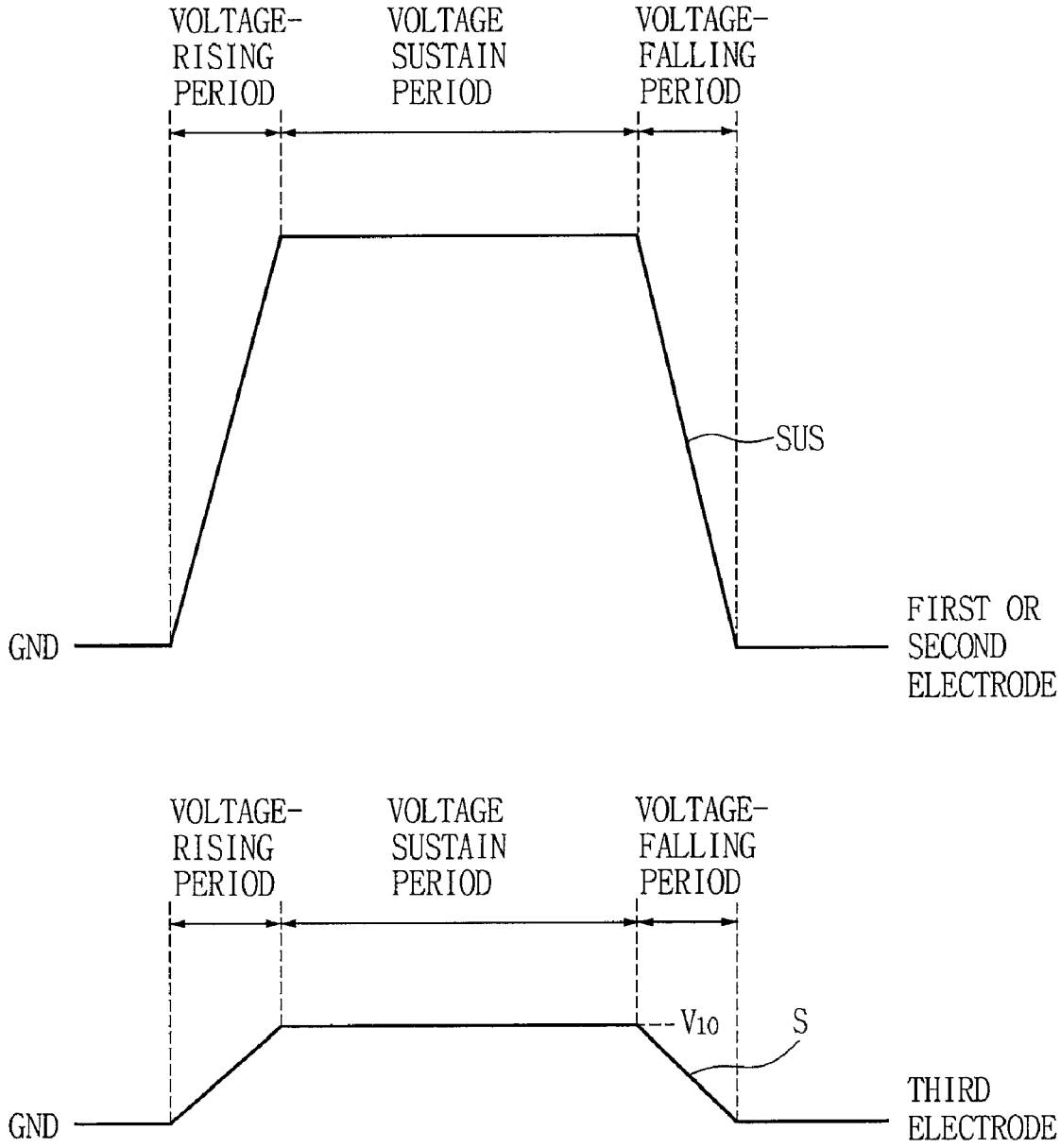
FIGS. 7*a* and 7*b* are diagrams showing an auxiliary signal of FIG. 5 in detail.
Figure 7B:
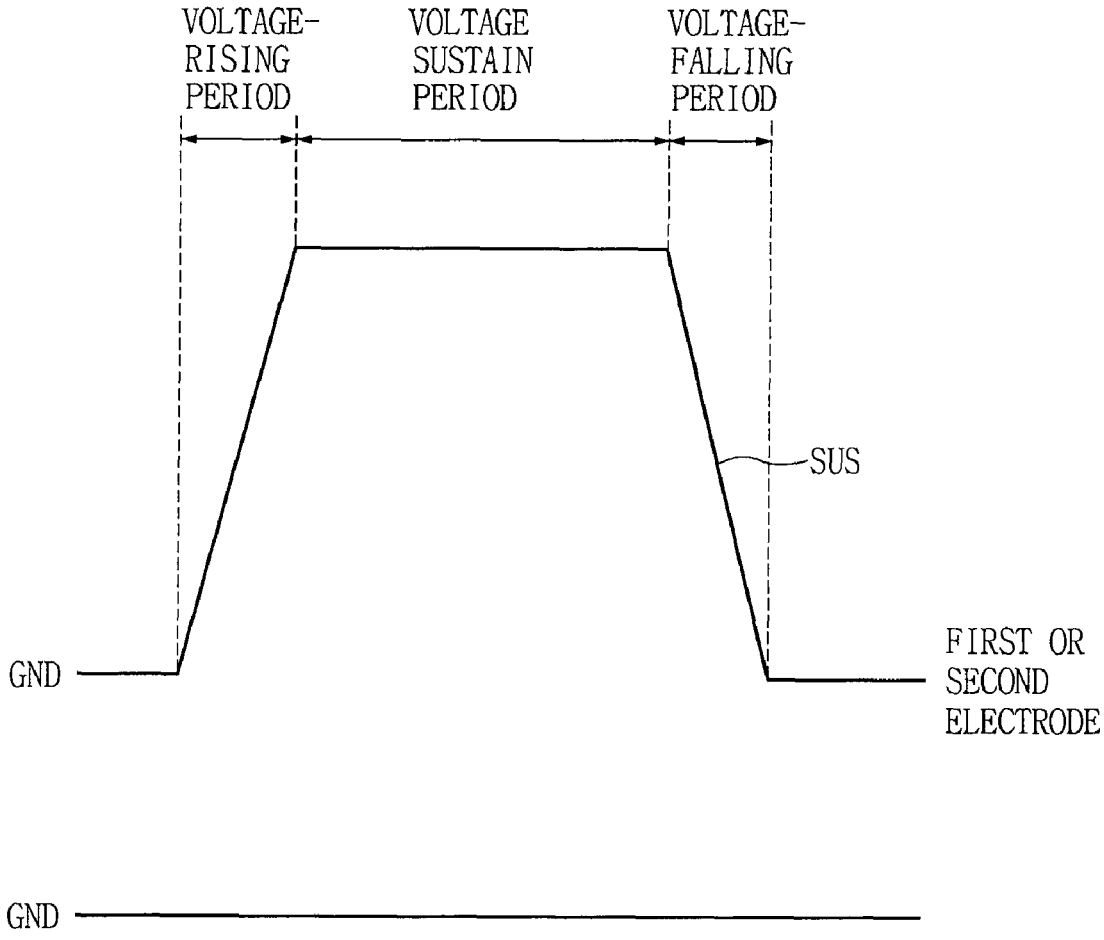

During the sustain period of the first frame F, a sustain signal SUS is supplied to the first or second electrode, and a ground voltage is supplied to the third electrode, as shown in FIG. 7B.

When sustain discharge is generated between the first electrode and the second electrode by a sustain signal supplied to at least one of the first electrode and the second electrode during the sustain period, positive ions in the discharge cell can move to the third electrode. The movement of positive ions to the third electrode is caused by a voltage difference between the first electrode and the third electrode or between the second electrode and the third electrodes. When positive ions are pulled toward the third electrode, the positive ions collide with the phosphor layer such that the phosphor layer is degraded. Further, due to the degradation of the phosphor layer, image sticking occurs on a screen, thereby reducing a lifespan of the plasma display panel.

When positive ions are pulled toward the third electrode, unnecessary discharge can be generated between the first and third electrode or between the second and third electrode during the sustain period. Such unnecessary discharge reduces an amount of wall charge required for sustain discharge within a discharge cell. Accordingly, an amount of light generated by the sustain discharge and the luminance thereof can be reduced, and driving efficiency can decrease.

On the other hand, when a sustain signal is supplied to the first or second electrode during the sustain period as shown in FIG. 7*a*, and if an auxiliary signal is supplied to the third electrode, a voltage difference between the first electrode and the third electrode or a voltage difference between the second electrode and the third electrodes decreases. Accordingly, the auxiliary signal suppresses positive ions from moving toward the third electrode. When the movement of positive ions is suppressed, image sticking caused by the degradation of the phosphor layer is suppressed from occurring. Further, a lifespan of the plasma display panel is expanded, and driving efficiency and luminance increase.

Since the auxiliary signal reduces a voltage difference between the first electrode and the third electrode 202 and 213 or between the second electrode 202 and the third electrode 213, the polarity of the auxiliary signal is the same as that of the sustain signal. For example, if the polarity of the sustain signal of FIG. 5 is positive, the polarity of the auxiliary signal is positive.

As described through FIG. 6, when the APL of the second frame is smaller than that of the first frame, that is, when the area of the second image IMG2 displayed during the second frame is smaller than that of the first image IMG1 displayed during the first frame, the number of sustain signals to be assigned to the second frame is larger than the number of sustain signals to be assigned to the first frame.

When the number of sustain signals to be supplied by the driver 110 of FIG. 1 increases, the probability also increases that positive ions collide with the phosphor layer. Therefore, the degradation of the phosphor layer increases during the second frame more than during the first frame. When the driver 110 supplies an auxiliary signal to the third electrode during the second frame, a voltage difference between the first electrode and the third electrode or between the second electrode and the third electrodes decreases. Accordingly, the degradation of the phosphor layer decreases.

In this embodiment, the reason why the absolute value of slope of the auxiliary signal in each of the voltage-rising period and the voltage-falling period is smaller than the absolute value of slope of the sustain signal in each of the voltage-rising period and the voltage-falling period is as follows. If the absolute value of slope of the auxiliary signal in each of the voltage-rising period and the voltage-falling period is larger, the number of positive ions moving from the third electrode to the first or second electrode increases so that sustain discharge can be unstabilized.

In this embodiment, the ratio of the highest voltage of the sustain signal to the highest voltage of the auxiliary signal, may range from 1.8 to 50, in order to prevent sustain discharge from being unstabilized when the number of positive ions moving from the third electrode to the first or second electrode increases.

As shown in FIG. 5, the driver 110 may supply an auxiliary signal S corresponding to the sustain signals SUS which are alternately supplied to the first electrode and the second electrode. Alternately, the driver 110 may supply an auxiliary signal S corresponding to only the sustain signal supplied to the first electrode. Further, the driver 110 may supply an auxiliary signal corresponding to only the sustain signal supplied to the second electrode.

Further, the driver 110 can supply an auxiliary signal S2 in at least one sub-field among the plurality of sub-fields of the second frame. For example, as shown in FIG. 5, the driver 110 does not supply an auxiliary signal in the sub-field SF1 of the second frame F2, but can supply an auxiliary signal S in the sub-field SF2 of the second frame F2.

Figure 8:
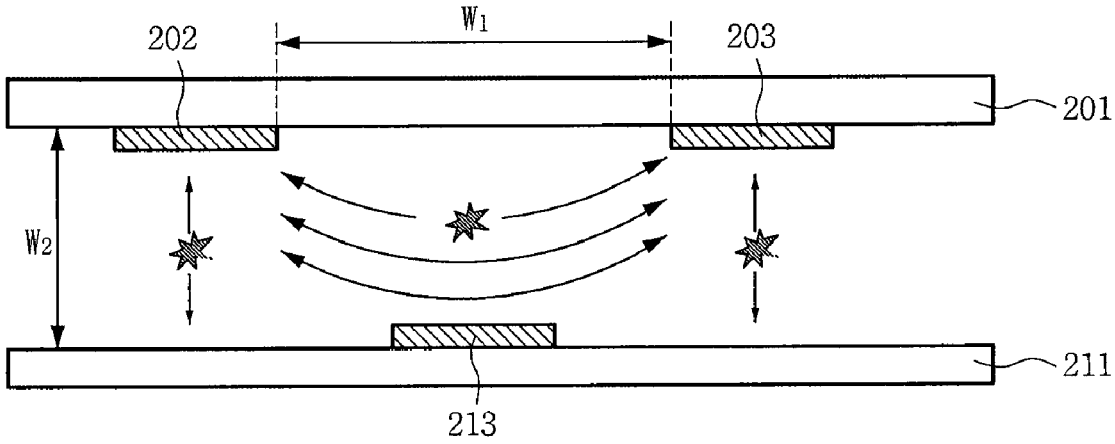
FIG. 8 is a diagram illustrating electrodes of the plasma display apparatus according to the embodiment of the invention.

In this embodiment, a distance W1 between the first electrode and the second electrode 202 and 203 can be larger than a distance W2 between the first electrode and the third electrode 202 and 213 or between the second electrode and the third electrodes 203 and 213, as shown in FIG. 8.

Accordingly, the number of positive ions moving between the first electrode and the third electrode 202 and 213 or between the second electrode and the third electrodes 203 and 213 during the sustain period increases. Therefore, when a sustain signal and an auxiliary signal are supplied during the second frame F2 having a larger APL than the first frame F1, a voltage difference between the first electrode and the third electrode 202 and 213 or between the second electrode and the third electrodes 202 and 213 decreases so that the degradation of the phosphor layer is effectively prevented.

For example, when the distance W1 between the first electrode and the second electrode 202 and 203 of FIG. 8 is equal to or more than 60 μm, and when an auxiliary signal is supplied, the degradation of the phosphor layer is prevented. Particularly, when the distance W1 between the first electrode and the second electrode 202 and 203 is equal to or more than 100 μm, and when an auxiliary signal is supplied, the degradation of the phosphor layer is prevented more effectively.

Figure 9A:
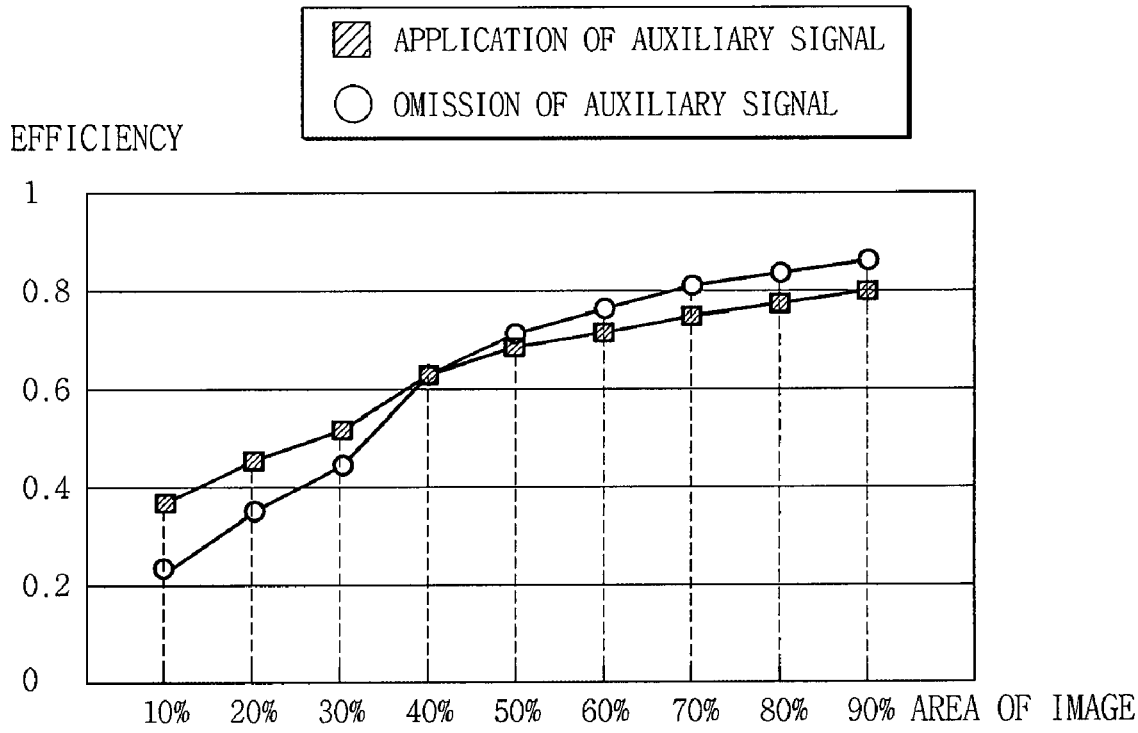
FIGS. 9*a* and 9*b* are diagrams showing an effect of an auxiliary signal.

As shown in FIG. 9*a*, when the area of the second image IMG2 of FIG. 6 is equal to or less than 40% of the entire effective region 600 of the plasma display panel, the efficiency when an auxiliary signal is supplied is larger than when an auxiliary signal is not supplied. That is, when the area of the second image IMG2 is equal to or more than 40% of the entire effective region 600 of the plasma display panel, and if an auxiliary signal is not supplied, it may be more effective.

Figure 9B:
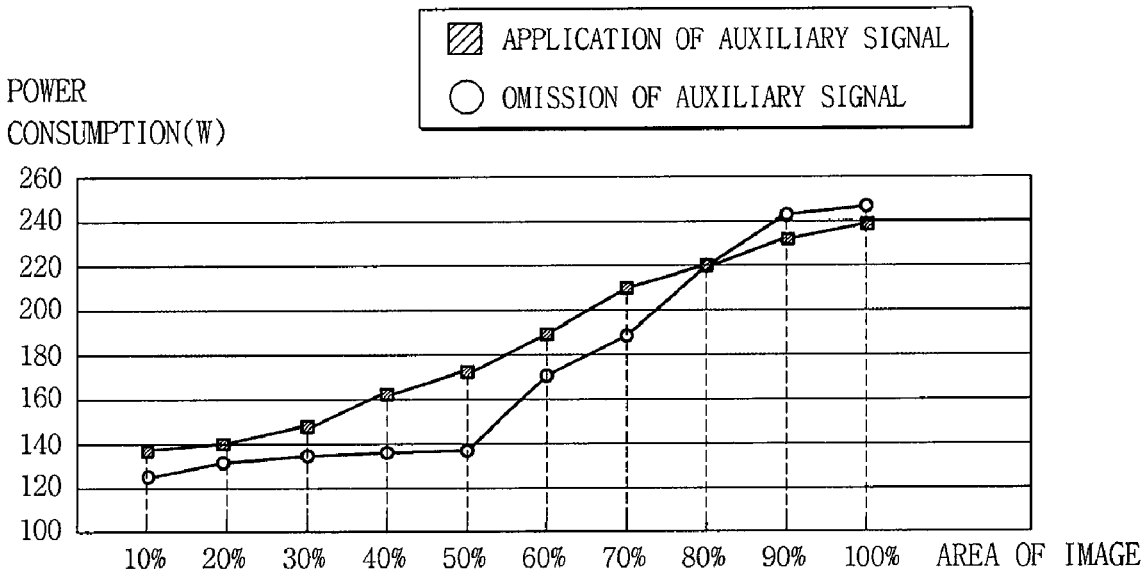

As shown in FIG. 9*b*, when the area of the second image IMG2 of FIG. 6 is equal to or more than 60% of the entire effective region 600 of the plasma display panel, and if an auxiliary signal is not supplied, power consumption rapidly increases. Accordingly, in this embodiment, when the area of the second image IMG2 is equal to or more than 60% of the entire effective region 600 of the plasma display panel, an auxiliary signal can be supplied.

In this embodiment, both of the efficiency and power consumption can be considered. In this case, when the area of the second image IMG2 of FIG. 6 is equal to or more than 60% of the entire effective region 600 of the plasma display panel, an auxiliary signal is not supplied. Further, the area of the second image IMG2 of FIG. 6 is less than 60% of the entire effective region 600 of the plasma display panel, an auxiliary signal is supplied.

Figure 10:
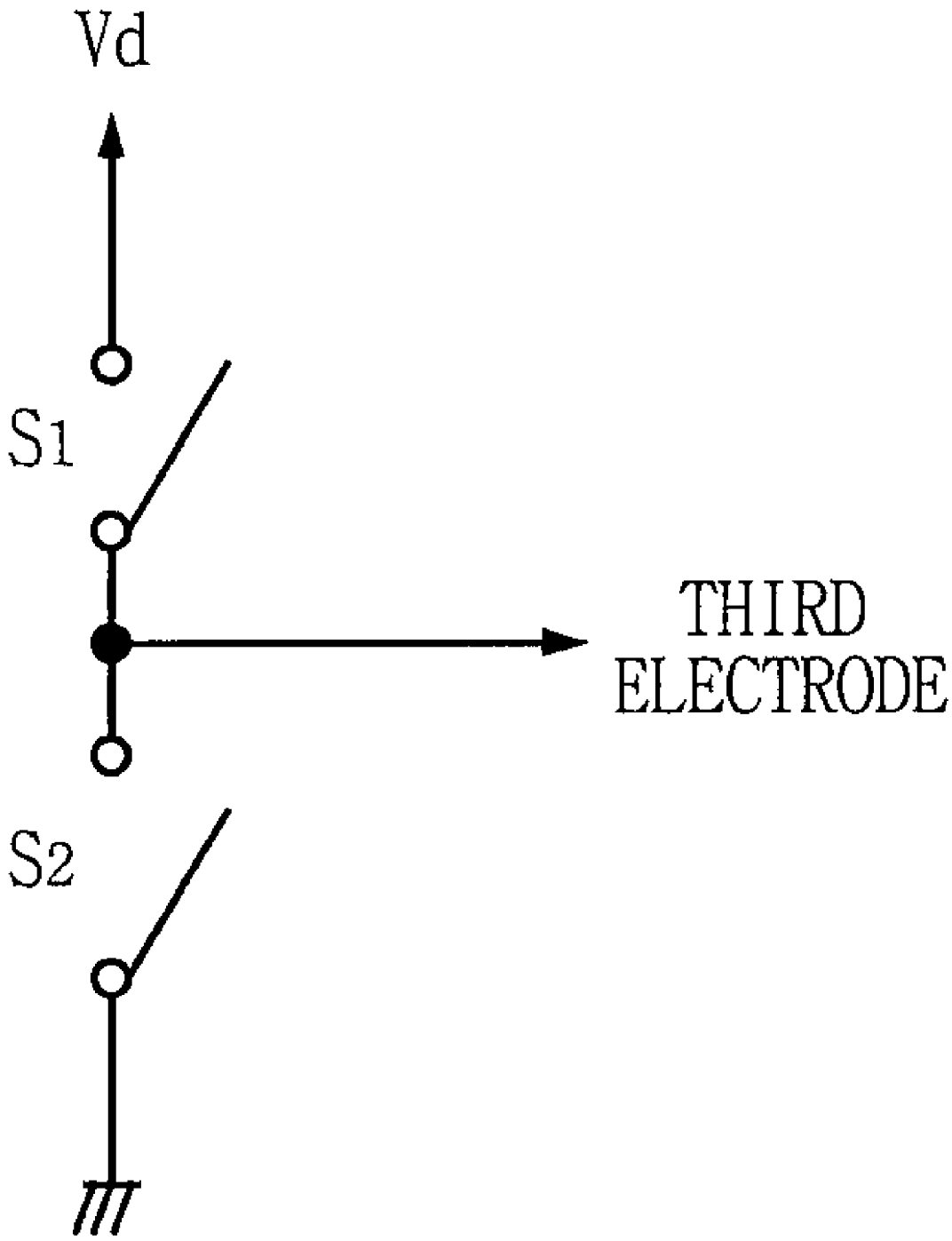
FIGS. 10 and 11 are diagrams showing the supply of auxiliary signal through the floating of a third electrode.
Figure 11:
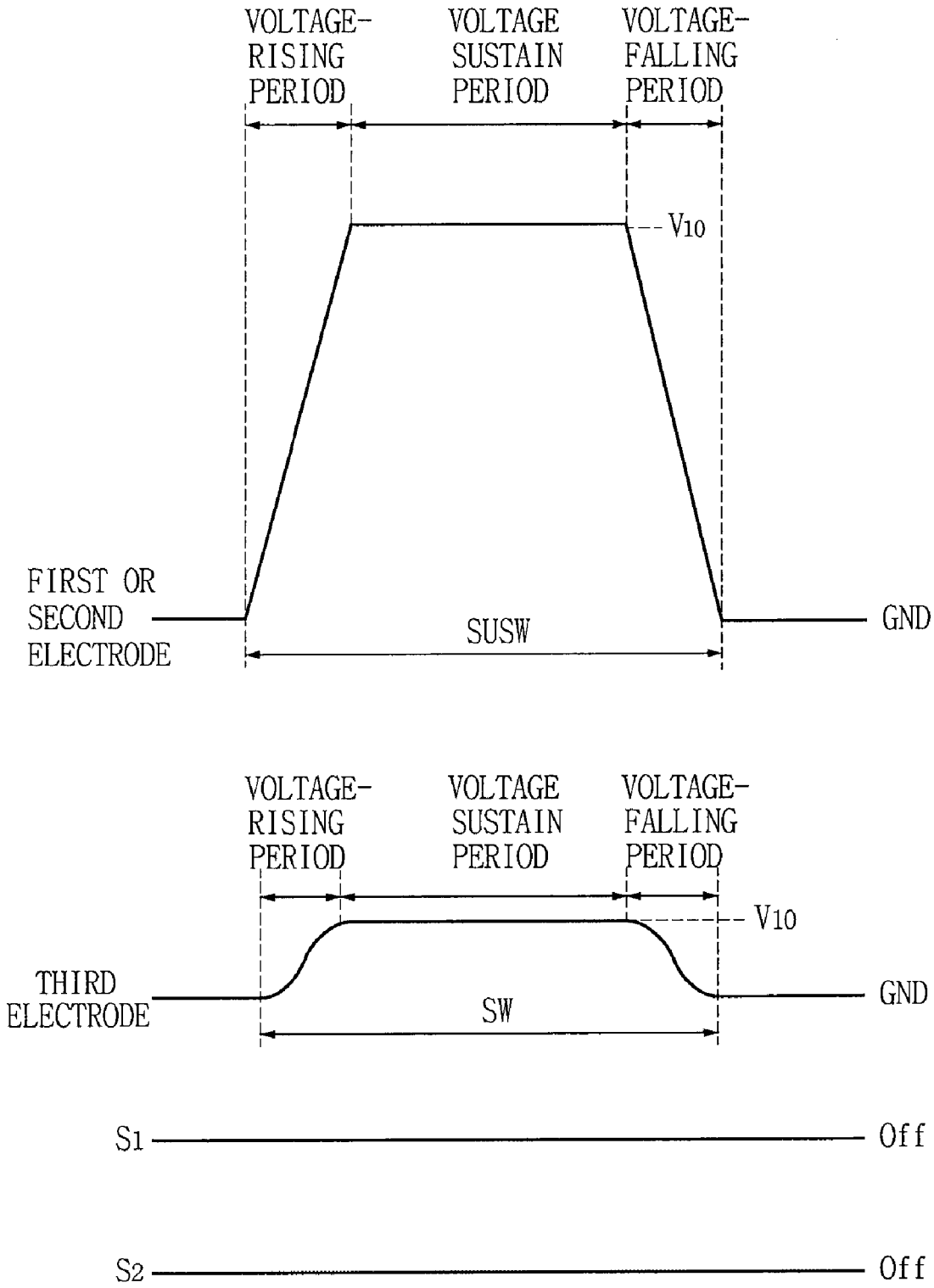

The driver 110 of FIG. 1 comprises first and second switches S1 and S2 of FIG. 10*a*, in order to supply a data signal. The driver 110 turns on the first switch S1 so as to supply a high-level data signal to the third electrode. Further, the driver 110 turns on the second switch S2 so as to supply a low-level data signal to the third electrode. The driver 110 supplies a sustain signal to the first or second electrode and simultaneously floats the third electrode. That is, the driver 110 turns off the first and second switches S1 and S2 of FIG. 10 so as to float the third electrode. Accordingly, the voltage of the third electrode gradually rises to the highest voltage V10 due to the influence of the sustain signal supplied to the first or second electrode.

As such, the driver 110 floats the third electrode so as to supply an auxiliary signal. Therefore, the voltage-rising period, the voltage sustain period, and the voltage-falling period of an auxiliary signal are proportional to those of a sustain signal. Further, the width sw of an auxiliary signal is proportional to the width susw of a sustain signal.

Further, since an auxiliary signal is supplied by the floating of the third electrode, the level of the highest voltage V10 of the auxiliary signal can be lower than that of the highest voltage Vd of a data signal.

The embodiment of the invention being thus described, it will be obvious that the same may be varied in many ways. Such variations are not to be regarded as a departure from the spirit and scope of the invention, and all such modifications as would be obvious to one skilled in the art are intended to be comprised within the scope of the following claims.

What is claimed is

1. A plasma display apparatus comprising:

a plasma display panel including a first electrode, a second electrode, and a third electrode crossing the first electrode and the second electrode; and a driver supplying sustain signals to the first electrode and the second electrode and supplying a constant voltage to the third electrode during a sustain period of a first frame, and supplying sustain signals to the first electrode and the second electrode and supplying an auxiliary signal to the third electrode corresponding to at least one sustain signal of the sustain signals supplied to the first electrode and the second electrode during a sustain period of a second frame having an average picture level (APL) smaller than an average picture level (APL) of the first frame, wherein the auxiliary signal is not supplied to the third electrode during the sustain period of the first frame.

2. The plasma display apparatus according to claim 1, wherein the polarity of the sustain signal is the same as that of the auxiliary signal.

3. The plasma display apparatus according to claim 1, wherein the driver supplies a data signal to the third electrode during an address period, and the level of the highest voltage of the auxiliary signal is lower than that of the data signal.

4. The plasma display apparatus according to claim 1, wherein the constant voltage is substantially equal to a ground-level voltage.

5. The plasma display apparatus according to claim 1, wherein an overall supply period of each of the sustain signal and the auxiliary signal comprises a voltage-rising period, a voltage sustain period, and a voltage-falling period, and an absolute value of slope of the auxiliary signal in each of the voltage-rising period and the voltage-falling period is smaller than that of the sustain signal in each of the voltage-rising period and the voltage-falling period.

6. The plasma display apparatus according to claim 1, wherein the ratio of the highest voltage of the sustain signal to the highest voltage of the auxiliary signal, ranges from 1.8 to 50.

7. The plasma display apparatus according to claim 1, wherein a distance between the first electrode and the second electrode is equal to or more than 60 μm.

8. The plasma display apparatus according to claim 1, wherein a distance between the first electrode and the second electrode is equal to or more than 100 μm.

9. The plasma display apparatus according to claim 1, wherein the distance between the first electrode and the second electrode is larger than a distance between the first electrode and the third electrode or between the second electrode and the third electrodes.

10. The plasma display apparatus according to claim 1, wherein the driver supplies the sustain signal and the auxiliary signal in at least one sub-field among a plurality of sub-fields of the second frame.

11. A plasma display apparatus comprising:

a plasma display panel including a first electrode, a second electrode, and a third electrode crossing the first electrode and the second electrode; and a driver supplying sustain signals to the first electrode and the second electrode and supplying a constant voltage to the third electrode during a sustain period of a first frame in which a first image is displayed, and supplying sustain signals to the first electrode and the second electrode and supplying an auxiliary signal to the third electrode corresponding to at least one sustain signal of the sustain signals supplied to the first electrode and the second electrode during a sustain period of a second frame in which a second image having an area smaller than an area of the first image is displayed, wherein the auxiliary signal is not supplied to the third electrode during the sustain period of the first frame.

12. The plasma display apparatus according to claim 11, wherein the polarity of the sustain signal is the same as that of the auxiliary signal.

13. The plasma display apparatus according to claim 11, wherein the driver supplies a data signal to the third electrode during an address period, and the highest voltage level of the auxiliary signal is lower than that of the data signal.

14. The plasma display apparatus according to claim 11, wherein the plasma display panel comprises an effective region in which light is emitted and an ineffective region in which light is not emitted, and the area of the second image is more than 40% of the effective region.

15. The plasma display apparatus according to claim 11, wherein the plasma display panel comprises an effective region in which light is emitted and an ineffective region in which light is not emitted, and the area of the second image is more than 60% of the effective region.

16. The plasma display apparatus according to claim 11, wherein a distance between the first electrode and the second electrode is equal to or more than 100 μm.

17. The plasma display apparatus according to claim 11, wherein the distance between the first electrode and the second electrode is larger than a distance between the first electrode and the third electrode or between the second electrode and the third electrodes.

18. The plasma display apparatus according to claim 11, wherein the driver supplies the sustain signal and the auxiliary signal in at least one sub-field among a plurality of sub-fields of the second frame.

19. A plasma display apparatus comprising:

a plasma display panel including a first electrode, a second electrode, and a third electrode crossing the first electrode and the second electrode; and a driver supplying sustain signals to the first electrode and the second electrode and supplying a constant voltage to the third electrode during a sustain period of a first frame, and supplying sustain signals to the first electrode and the second electrode and floating the third electrode to correspond to at least one sustain signal of the sustain signals supplied to the first electrode and the second electrode during a sustain period of a second frame having an APL smaller than an APL of the first frame, wherein the third electrode is not floated during the sustain period of the first frame.

20. The plasma display apparatus according to claim 19, wherein a distance between the first electrode and the second electrode is 100 μm.

21. The plasma display apparatus according to claim 19, wherein the driver comprises a first switch supplying a highest voltage of a data signal and a second switch supplying a lowest voltage of a data signal during the sustain period of the first frame and the second frame, wherein the third electrode is floated when the first switch and the second switch are turned off during the sustain period of the second frame, the third electrode is not floated when the first switch is turned off and the second switch is turned on during the sustain period of the second frame.

* * * * *